US007628432B2

(12) United States Patent
Flather

(10) Patent No.: US 7,628,432 B2
(45) Date of Patent: Dec. 8, 2009

(54) MULTI-PURPOSE EATING UTENSIL

(75) Inventor: Charles Flather, 14545 J. Military Trail #156, Delray Beach, FL (US) 33484

(73) Assignee: Charles Flather, Delray Beach, FL (US)

( * ) Notice: Subject to any disclaimer, the term of this patent is extended or adjusted under 35 U.S.C. 154(b) by 275 days.

(21) Appl. No.: 11/369,709

(22) Filed: Mar. 6, 2006

(65) Prior Publication Data

US 2007/0205619 A1 Sep. 6, 2007

(51) Int. Cl.
*A47J 43/28* (2006.01)

(52) U.S. Cl. ..... 294/3; 294/99.2; 30/147; 30/150

(58) Field of Classification Search ..... 294/3, 294/99.2; 30/147, 149, 150, 324; D7/685, D7/686

See application file for complete search history.

(56) References Cited

U.S. PATENT DOCUMENTS

| | | | | | |
|---|---|---|---|---|---|
| 177,546 | A | * | 5/1876 | Nugent | 30/131 |
| 220,390 | A | * | 10/1879 | Koska | 294/99.2 |
| 1,351,045 | A | * | 8/1920 | Larson | 30/122 |
| 1,488,463 | A | * | 4/1924 | Abram | 30/147 |
| 1,984,081 | A | | 12/1934 | Pisculli | |
| D138,917 | S | * | 9/1944 | Frank | D7/686 |
| 2,839,830 | A | * | 6/1958 | Neiman Jr. | 30/147 |
| 3,727,306 | A | | 4/1973 | Patik | |
| 4,521,964 | A | * | 6/1985 | Maruyama | 30/148 |
| 4,535,538 | A | * | 8/1985 | Nelson | 30/147 |
| D297,899 | S | * | 10/1988 | Kato | D7/686 |
| 4,984,367 | A | | 1/1991 | Albanese | |
| 5,373,640 | A | | 12/1994 | Cordeiro, Jr. | |
| 6,276,734 | B1 | | 8/2001 | Krieger | |
| 6,457,238 | B1 | | 10/2002 | Maier et al. | |
| 2004/0221459 | A1 | * | 11/2004 | Rich | 30/324 |
| 2008/0036226 | A1 | * | 2/2008 | Yoon | 294/3 |

FOREIGN PATENT DOCUMENTS

| | | | |
|---|---|---|---|
| JP | 2003-265297 | * | 9/2003 |

* cited by examiner

*Primary Examiner*—Dean J Kramer
(74) *Attorney, Agent, or Firm*—Pablo Meles; Akerman Senterfitt

(57) ABSTRACT

An eating utensil (100) is provided for serving among a fork, a spoon, a pair of chopsticks, or a knife. The eating utensil (100) can have a handle (102) with two members (104, 106) separated and extending from a base portion (108). A first member opens into a first spoon portion (110) having a first irregular shaped interior edge (114). A second member opens into a second spoon portion (120) having a second irregular shaped mating interior edge (124). A closing of the two members mates the first interior edge and the second interior edge for creating a spoon aspect. An opening of the two members can provide a dual prong aspect as a fork. The irregular shaped edge can have a winding contour (115) followed by a straight contour (116). An outer edge (111) of a spoon portion can provide a cutting edge leading to a tine (112).

19 Claims, 4 Drawing Sheets

MULTI-PURPOSE EATING UTENSIL

FIELD

This invention relates generally to eating utensils, and more particularly to an eating utensil having a combinational functionality among chopsticks, spoon, knife, and fork.

BACKGROUND

Eating utensils such as the spoon, knife, and fork are common tableware items of cutlery people use for eating. The utensils allow individuals to manipulate and handle their food in a manner determined by the form and function of the eating utensil. A knife generally has a sharp edge and can be used to cut and divide food morsels into smaller size pieces. A fork generally includes three or four tines for manipulating and holding food objects. The fork can be used to poke, prod, or grapple pieces of food, hold onto pieces of food, or hold down pieces of food. A spoon has a generally concave surface for conveying food or liquid to the mouth or for stirring. A spoon has a generally smooth continuous contour for holding or eating liquid or semi-liquid foods, such as soup, stew, or ice cream, and very small items which cannot be easily captured or lifted with a fork.

A hybrid form of cutlery is the spork which includes a combination of a fork, spoon, and knife. It is based upon a spoon, with the addition of the tines of a fork, and sometimes the serrated edge of a knife. Various utensils such as tongs, chopsticks, serving spoons, scoopers, scissor tongs, bendable utensils, and easy grip utensils, have also been used for providing novel means of working with food. Special need utensils also exist which combine various functionalities of the spoon, knife, and fork into one utensil for allowing disabled persons to more effectively handle food.

In general, people have adapted well to currently available utensils such as the fork, spoon, and knife. These utensils can be used together in various arrangements for accomplishing a specific function for handling and manipulating food. A person can adequately adapt to the function and form of the utensil. For example, a user can learn that a spoon is more useful for handling liquids than is a fork or knife. A user can recognize that a fork is more useful for holding down food objects than a spoon. Users learn to adapt the manner in which they manipulate food based on the utensil being handled.

There are certain times for which standard eating utensils are used in conjunction with another utensil for accomplishing a specific function. For example, a knife may be used in combination with a fork to push a piece of food onto a fork. This combinational approach can be used when a piece of food tends to slide around or is not directly accessible. A user is generally required to use both hands to simultaneously handle both utensils. However, in certain cases, a user may only have one hand available or access to only one eating utensil. In these conditions, the user can be required to learn how to accomplish the same functions given only one utensil which may not provide adequate functionality. A need therefore exists for an eating utensil that provides multifunctional capabilities within a single design.

SUMMARY

Various embodiments in accordance with the present invention provide a eating utensil having characteristics among a spoon, fork, knife, and chopsticks. The eating utensil can be handled to function as a fork in a first arrangement and a spoon in a second arrangement. The eating utensil can also be handled to function as chopsticks or as a knife. The eating utensil can have a first member having a first spoon portion with a first irregularly shaped interior and a second member having a second spoon portion with a second irregularly shaped interior. The first spoon portion can lead to a first tine and the second spoon portion can lead to a second tine. The first and second spoon portions can have a winding interior edge followed by a straight edge leading to a tine. The first and second spoon portions can also include a sharp outer edge for providing a knife aspect. In one arrangement, the tines can be used as chopsticks for manipulating food objects by opening and closing the first and second member. The tines can have a tip area approximating the tip of a fork tine and can include ridges for gripping.

In a first position, the first tine of the first spoon portion and the second tine of the second spoon portion can be separate for serving as a fork. In a second position, the first member and the second member can be squeezed or biased together for mating the first irregularly shaped interior of the first spoon portion and the second irregularly shaped interior of the second spoon portion for serving as a spoon. The first spoon portion and the second spoon portion can have a generally flat and downward tapering bottom for providing a scooping and support platform. The eating utensil can be manufactured from the same material into a continuous single or integrated article of manufacture.

DETAILED DESCRIPTION OF THE DRAWINGS

Figure 1A:
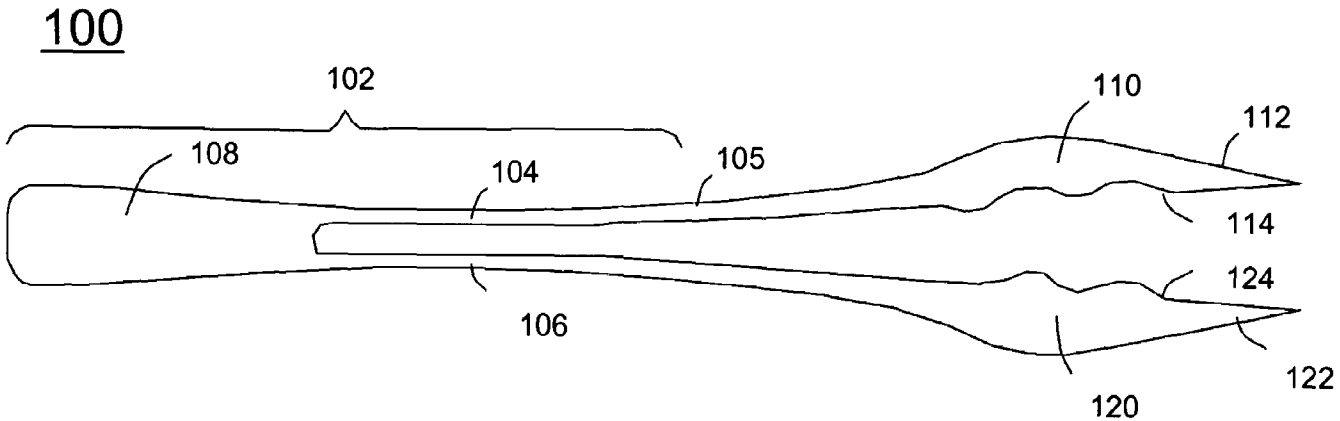
FIG. 1A is a top view illustration of the multi-purpose eating utensil in an open configuration for providing a fork aspect in accordance with an embodiment of the present invention.

While the specification concludes with claims defining the features of embodiments of the invention that are regarded as novel, it is believed that the invention will be better understood from a consideration of the following description in conjunction with the figures, in which like reference numerals are carried forward.

Embodiments herein provide an eating utensil that can be configured as a fork in a first arrangement, a spoon in a second arrangement, a pair of chopsticks in a third arrangement, and a knife in a fourth arrangement and combinations thereof in other various arrangements. The eating utensil can include a first member having an irregular shaped interior edge and a second member having a mating irregular shaped interior edge. The eating utensil can serve as a fork in a first configuration, and a spoon in a second configuration when the first and second members are mated. The first and second member can be coupled at a connection point which provides the arrangement.

Referring to FIG. 1A, a top view illustration of the multi-purpose eating utensil 100 is shown. In an open configuration, the multi-purpose eating utensil provides a fork aspect in accordance with an embodiment of the present invention. The eating utensil 100 can have a handle 102 having two members 104 and 106 that are approximately parallel within a first segment and extending longitudinally from a base portion 108. The two members 104 and 106 can extend along a second segment at a region 105 wherein the opening between the two members increases from a narrow space to a wider space. The width of the two members 104 and 106 can begin to thin at a region 105 for ergonomic purposes such as for allowing a placement of a finger tip within an approximately flattened area. For example, when the utensil is turned upside down, an index finger can be positioned along the region 105 for exerting downward pressure when the eating utensil 100 is used in a fork aspect. Understandably, having too much separation between the members 104 and 106 could make pressing down on the region 105 with a single finger tip more difficult. The natural separation between 104 and 106 in the open configuration is sufficient to allow a single finger tip to be placed on the region 105 for the purposes stated.

The first member 104 can open into a first spoon portion 110 or first half spoon having a first interior edge 114. The second member 106 can open into a second spoon portion 120 having a second interior edge 124. A closing of the two members 104 and 106 can mate the first interior edge 114 and the second interior edge 124 for creating a spoon aspect. The term "half" denotes a first portion that can be combined with a second portion for creating a whole portion and does not necessarily imply half the volume or surface area of the spoon. The half-spoon need not be a mirror image or an exact mathematical half of an object. For example, a first spoon portion can contain a greater area than a second spoon portion. The first member 104 and the second member 106 can be approximately parallel and in the same plane as the handle 102. For example, the handle 102 and the two members 104 and 106 can be relatively flat within the first segment.

Figure 1B:
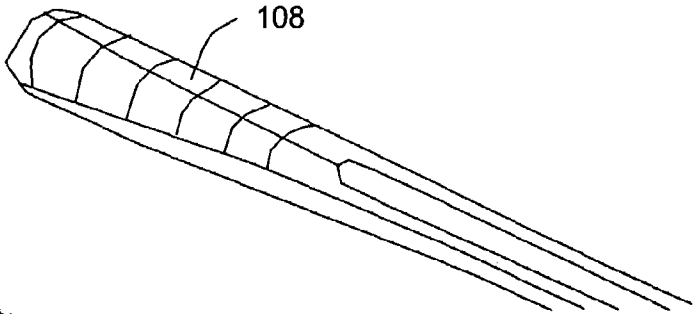
FIG. 1B is a view of a handle portion of the multi-purpose eating utensil in accordance with an embodiment of the present invention.

Referring to FIG. 1B, the handle 102 is shown. Notably, the handle has an elongated and round-like base 108 which provides ergonomic benefit as well as balancing. The base 108 can have sufficient dimension and weight to counter balance the members 110 and 120 when the eating utensil 100 is held in the hand or balanced between an index finger and a thumb. The base also provides sufficient strength to keep the two members 104 and 106 separated while providing structural rigidity. The base can have a tapered end with a rounded contour, though embodiments herein are not limited to these characteristics. The two members 104 and 106 can decrease in thickness at the region 105 as shown in FIG. 1C, which shows a perspective drawing.

Figure 1C:
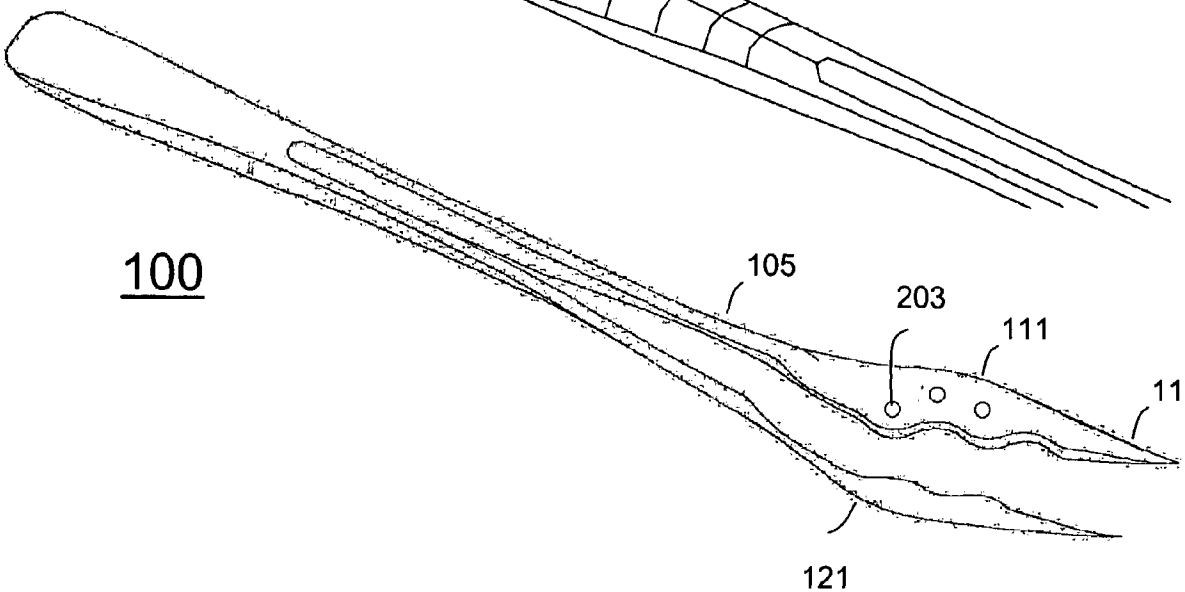
FIG. 1C is a perspective view of the multi-purpose eating utensil in accordance with an embodiment of the present invention.

FIG. 1C presents a perspective illustration of the eating utensil 100 in an open configuration for providing a fork aspect in accordance with an embodiment of the present invention. The perspective also reveals the design transition between the outer edge (rim) 111 of the half spoon and a tine 112. For example, the outer edge 111 of the spoon portion 110 leads to an outer edge of a first tine 112, and the interior edge 114 of the spoon portion 110 leads to an interior edge of the first tine 112.

Figure 2A:
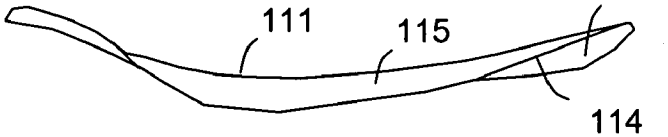
FIG. 2A is an interior side view illustration of a half spoon portion in accordance with an embodiment of the present invention.

Referring to FIG. 2A, a side view of the eating utensil 100 is shown for the half spoon section 110. One side of the interior 114 shows the windy interior 115, and the other side shows a tine 116. When the two members 104 and 106 are closed the eating utensil 100 can be used in a spoon aspect. The spoon-like sides 110 and 120 have slight upward curvature with a relatively shallow height. The spoon aspect can have a relatively shallow interior compared to a normal spoon such as a teaspoon or soup spoon. That is, the depth (i.e. height) of the spoon when measured from the outside edge to the depression of the interior bowl region can be relatively shallow. Notably, the eating utensil 100 has a shallow and flat aspect 111 which is more comfortable against the upper lip than the rim design of a normal spoon for using the utensil in a fork aspect.

Figure 2B:
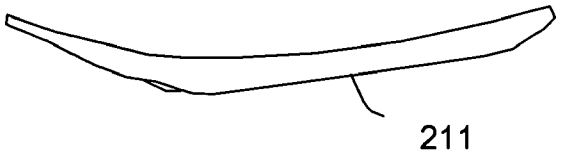
FIG. 2B is an exterior side view illustration of a half spoon portion in accordance with an embodiment of the present invention.
Figure 2C:
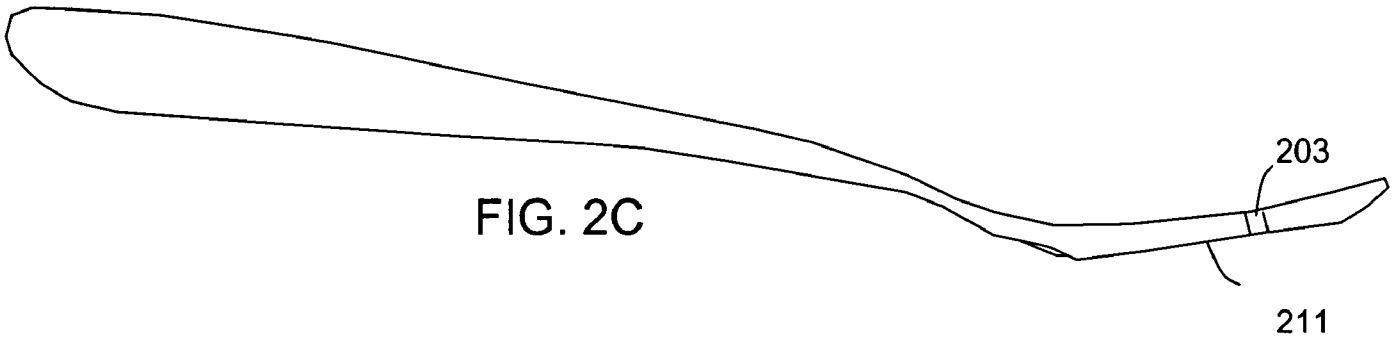
FIG. 2C is a side view of the multi-purpose eating utensil in accordance with an embodiment of the present invention.

The bottom edge 211, as shown in FIG. 2B, shows that the underside of the eating utensil 100 is relatively flat which allows the eating utensil to better slide under food objects such as a fork. Food can be more easily elevated into the platform region 302 due to the flatness of the bottom edge 211 when the eating utensil 100 is used in a tong configuration. Referring to FIG. 2C, a side view of the eating utensil 100 is shown. Notably, the side profile resembles the profile of a fork, particularly, the flat underside 211 of the windy interior 115 and tine section 116, as seen in FIG. 2A. The shallow and flat aspect of the eating utensil 100 allows it to be used as a fork while providing the same sensation as eating with a fork; that is, the rim (outer edge) 111 is hardly sensed by the lips. The eating utensil 100 provides novel design change improvements over the normal spoon which include the shallowness aspect and a non-planar outer rim. Whereas in normal spoons, the outer rim is generally in one plane, the outer rim 111 of the eating utensil 100 curves down a little, like a saddle. The eating utensil 100 may also not have as pronounced a depression within the bowl region of the spoon aspect as a standard spoon. Accordingly, the underside region 211 as shown in FIG. 2B is generally flat. The flatter depth of the spoon aspect allows it to be used as a flat serving type utensil as well as a spoon.

Referring to FIG. 2C a complete side view of the eating utensil 100 is shown for illustrating the relative shallow aspect of the spoon bowl. Notably, the height of the spoon along the center bowl region can be relatively constant and flat. The first and second spoon portions 110 and 120 are generally not as curved or deep as a teaspoon or a soup spoon. The center bowl region, also called the platform, can be relatively flat with sides slightly curved up to the outer edge 111. The interior bowl region may also contain drain holes 203 (more closely seen in FIG. 1C) within the bowl region for draining fluids from the spoon portion. The spoon-like platform is slightly curved in the front and back direction 211 and in the side to side direction, though it is more planar than a standard spoon, such that the back and forth direction provides under curvature similar to a fork. The side view of FIG.

2C reveals that the side profile of the eating utensil 100 is similar to the side profile of a fork.

Figure 2E:
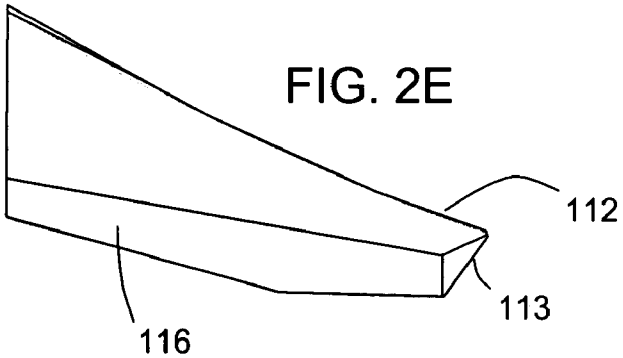
FIG. 2E is an illustration of a left tine corresponding to spoon section in accordance with an embodiment of the present invention.
Figure 2D:
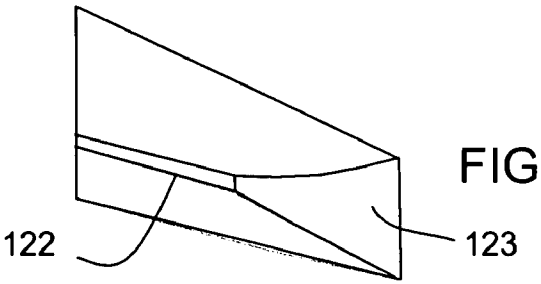
FIG. 2D is an illustration of a right tine corresponding to spoon section in accordance with an embodiment of the present invention.

Referring to FIG. 2D, the right tine is shown which corresponds to the second spoon section 120. The tine tip 123 has a sufficiently flat face that leads to the cutting edge 122. The cutting edge can increase from dull to sharp as the cutting edge moves 122 away from the tine and towards the handle. Referring to FIG. 2E, the left tine is shown corresponding to the first spoon section 110. The tine tip 113 has a sufficiently flat face that leads to the cutting edge 112. The cutting edge can increase from dull to sharp as the cutting edge moves 112 away from the tine and towards the handle. The interior of the tine 116 shows a flat underside aspect near the tine tip 113 for allowing the tines to get under food objects.

Figure 3A:
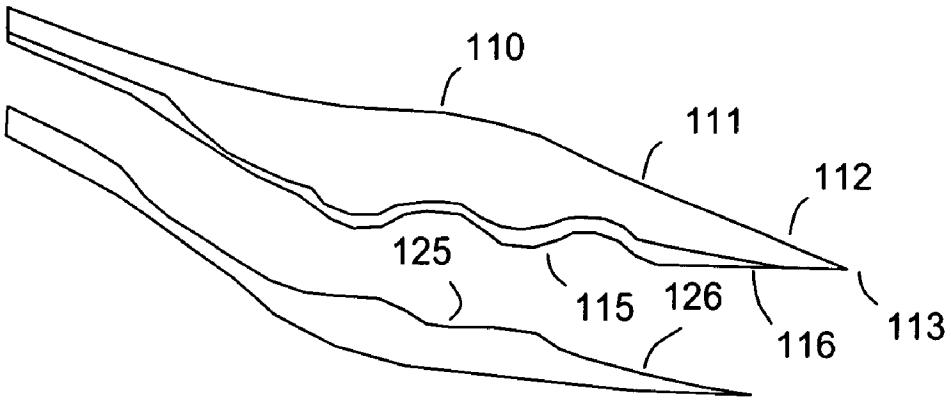
FIG. 3A is a top perspective view illustrating interior edges of the multi-purpose eating utensil in accordance with an embodiment of the present invention.

Referring to FIG. 3A a detailed view of the half-spoon portions are shown. Each outer edge of a spoon portion can lead to a tine. For example, the outer edge 111 of the first spoon portion 110 can lead to a first tine 112. The first tine 112 may slightly project forward like a spire to a tine tip 113 or naturally curve into the tine tip 113. The outer edge of the second spoon portion can also lead to a second tine that likewise can project forward like a spire to a tine tip. The tip of the two tines can be approximately the size of a standard fork tine. The tines can include ridges for gripping and handling. The tines can slightly project forward providing a prong like characteristic. In use, the first tine 112 and the second tine can together provide a fork aspect when the two members 104 and 106 are at least partially open, and together provide a single prong aspect when the two members 104 and 106 are closed. In this arrangement, the eating utensil can be used as a forked tong for grasping, poking, or prodding food objects. A user can also open and close the two members 104 and 106 with a single hand for grabbing and maneuvering food objects. In an extended arrangement, a user can employ a first eating utensil 100 in one hand and a second eating utensil 100 in a second hand.

Figure 3B:
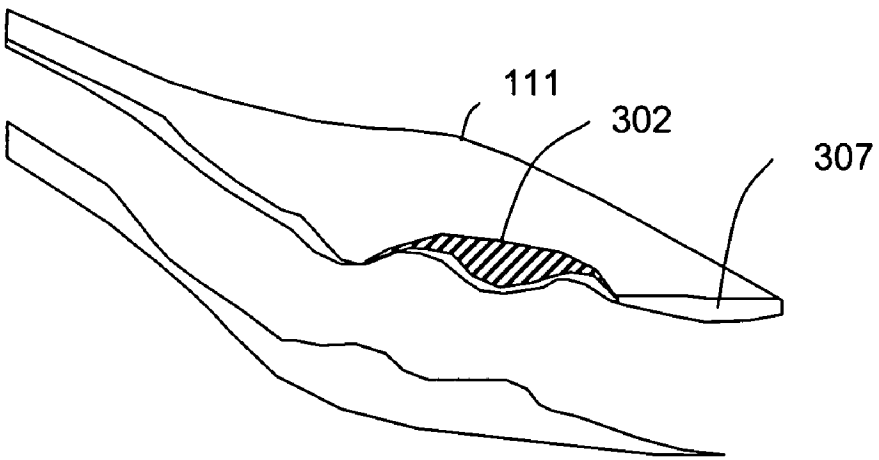
FIG. 3B is a top perspective view illustrating an interior bowl region of the multi-purpose eating utensil in accordance with an embodiment of the present invention.

FIG. 3B shows the relative contour and shallowness of the spoon aspect, the material width, and the spoon portion curvature. For example, the outer edge 111 of the eating utensil 100 curves slightly upward with a material width of relatively small thickness. The material is generally thicker on an outside edge versus the interior region where the width of the material is smaller or thinner. The platform region can occupy the lower portion of the spoon bowl, and is generally wide within the center spoon bowl region. For example, 302 shows a hatched region for the platform region in the first half spoon 110. Notably, the thickness of the eating utensil decreases progressively as the sides taper downward into the center spoon bowl providing the platform region. This characteristic can be seen in 307 of FIG. 3B which shows the material width decreasing from the outside rim to the interior bowl region. Notably, the spoon-like sides 110 and 120 are thin with a thickness similar to a standard spoon. The thickness of the spoon-like sides decreases towards the center of the bowl region. Accordingly, the inside edges 115 and 125 are thinner for elevating food. To note, the tines 116 and 126 are thicker than the spoon-like sides 110 and 120.

Referring now to the interior aspects of the eating utensil 100 in FIG. 3A, the interior edges of the spoon portions can exhibit two distinctly different contours. The first interior edge 114 can have a first winding contour 115 followed by a straight contour 116. The second interior edge can also have a second winding contour followed by a straight contour (see FIG. 1A). The second winding contour is complementary to the first winding contour 115 such that a closing of the first member 104 (see FIG. 1A) with the second member 106 conjoins the first interior edge 114 and second interior edge for creating a spoon aspect. Understandably, the first interior edge 114 and second interior edge are complementary designs such that the mating of the first spoon portion 110 and second spoon portion 120 creates an enclosed spoon cavity. In one aspect, the first interior edge 114 and the second interior edge can be coated or supplemented with a material for providing at least a semi-sealed mating. For example, a small plastic tubing or material coating can be applied to the interior edge for seal proofing the mating though the design is not limited to sealed spoon aspect. In some embodiments within the contemplated scope herein it may be useful to purposely allow some leaking at the interior edge or elsewhere within the spoon aspect.

The winding edges serve to add more edge area to the first and second interior edges for providing contact with food and for handling the food. The winding interior edges can help in picking up food objects, such as rice, when the two members are partially open, as they help to create a somewhat grid-like surface, which the rice may otherwise more easily fall through if the interior edges were straight. The winding edges also serve as a form of rounded teeth for facilitating grabbing and managing of food objects. Additionally, the gripping aspect of the rounded teeth may also prevent food from sliding off, such as spaghetti, when clenched between the winding interior edges.

In practice, a user can handle the eating apparatus 100 in a manner similar to a common fork or spoon. In a first orientation, the user can rest the handle midway between the index finger and the thumb such that the eating utensil 100 is facing up as shown in FIG. 1. In other words, the concavity of the spoon aspect formed by the first and second spoon portions 110/120 are oriented upwards. In the illustrated embodiments orientation, the eating utensil 100 can be used as a fork, a spoon, or a pair of chopsticks depending on the pressure exerted by the index finger and thumb on the two members within the handle region 102. An inward closing pressure on the first and second member 104 and 106 can cause the first spoon portion 110 and second spoon portion 120 to come together.

Referring back to FIG. 1, the first 104 and second 106 members can have relatively constant separation along a first section corresponding to an initial opening in the handle. The opening can widen at a second segment, corresponding to the region 105, wherein the first member 104 opens to the first spoon portion 110, and the second member 106 opens to the second spoon portion 120. The two members 104 and 106 can flatten and narrow at the region 105 as shown in FIG. 1C. The location of the two members 104 and 106 at the region 105 can approximately coincide with the placement of an index finger handling the eating utensil 100. For example, the handle 102 can rest midway between the index finger and thumb when the eating utensil is facing up as shown in FIG. 1. The fingers are positioned on the handle such that the index finger and the thumb can easily squeeze or bias the two members for manipulating the configuration of the eating utensil into a fork aspect or spoon aspect. The design also allows a user to squeeze the eating utensil 100 at almost any location along the opening between the first and the second members 104 and 106 for closing the eating utensil to form a spoon aspect.

In an open configuration, where no closing pressure is exerted on the two members, the eating utensil 100 remains in a naturally open position whereby the first spoon portion 110 and second spoon portion 120 are separated. The eating utensil 100 can be constructed from a unitary substantially rigid material, such as stainless steel or plastic, but is not herein limited to these, which inherently includes resilience for providing the separation. The material can be molded or manufactured to provide flexibility and spring which facilitates an opening and closing of the two members 104 and 106. The present embodiment provides for a natural separation of the first and second member due to the manufacture and composition of the material. In an alternate embodiment, the handle can include a joint with a spring mechanism for keeping the two members separated. Various manufacturing methods are contemplated herein other than those disclosed. Embodiments of the invention are not limited to keeping the two members 104 and 106 in a default open configuration. The eating utensil 100 may or may not also include a base 108. For example, in another arrangement (not shown) the eating utensil 100 may include a flexible material or spring mechanism inserted between the two members 104 and 106 for providing flexibility that serves to retain the members 104 and 106 with the use of a base. Understandably, in a natural state, the eating utensil 100 can remain in a default open configuration.

In a second orientation, the eating utensil 100 can be flipped over such that the index finger can be easily pressed up against the back of the handle 102 at the region 105 for exerting downwards force and using the eating utensil as a fork or prong. The index finger can be placed on the top or the bottom of the region depending on whether the eating utensil is used as a fork, a knife, or a spoon. In a second orientation, when the two members are separated, (i.e. open configuration), a first tine 112 and a second tine 122 allow the eating utensil 100 to be used as a fork. When the two members are squeezed together (i.e. closed configuration), the first tine 112 and second tine 122 become mated into a single point providing a prong aspect. Note the prong aspect is an optional feature in as much as alternatives designs can include a more blunt aspect that may not be considered a prong.

In a third orientation, the eating utensil can be flipped on a side for taking advantage of the sharp cutting edge provided by the outside edge of a spoon portion. Notably, the outside edge 111 of the first spoon like portion 110 is angled such that the eating utensil 100 can be more easily used as a knife. The angle of the outer edge is such that a user can turn the eating utensil on a side to use it as a knife with minimal change in gripping orientation. For example, using the edge of a normal fork as a knife requires a lower positioning of the fork handle to place the fork edge in a horizontal configuration. This is because the outer edge of a fork is along the same projection line as the fork handle. Accordingly, the user must position the fork handle at the same angle as the fork edge. In contrast, the outer edge 111 of the eating utensil is angled differently from the handle 102. Notably, the outer edge 111 is angled such that the eating utensil can be turned on its side to use the eating utensil as a knife without having to change the handling angle. The outer edge is angled such that a turning of the eating utensil on a side in a normal handling configuration positions the edge along a horizontal plane. The outer edge of the first half spoon 110 and/or the outer edge of the second half spoon 120 can include a sharp edge for use as a knife. For example, a right hand user may prefer the first half spoon to contain a knife edge, and a left hand user may prefer the second half spoon to contain a knife edge.

The first and second winding interior edges (or winding contours) 115 and 125 also provide stability when applying pressure to the eating utensil 100. Understandably, the rounded contour of the winding edges when conjoined against another winding edge of an opposing spoon portion provides more contact space for keeping the two members 104 and 106 rigidly connected and avoiding slipping. For example, referring to FIG. 1, the outside edge 111 of the first spoon portion 110 can be a sharp or serrated edge for cutting, or the outside edge 121 of the second spoon portion 120 can be a sharp or serrated edge. In one arrangement, the sharpness of the first cutting edge 111 or the second cutting edge 121 can blend into, or form into, tine ridges as the edge leads to the first tine 112 or the second tine 122, respectively.

In another aspect, the straight edge contour of an interior edge can provide a chopstick behavior that allows for handling and manipulation of food objects. This is in contrast to the gripping and tearing behavior provided by the winding interior edges. For example, referring to FIGS. 1A and 3A, the two straight edge contours 116 and 126 of the first and second member 104 and 106 provide a chopstick aspect for the first and second spoon portions 110/120. Squeezing pressure can be applied to the first member 104 and second member 106 for utilizing the eating utensil 100 as a pair of chopsticks. In particular, the first tine 112 leading from the first straight edge contour 116 together with the second tine 122 leading from the second straight edge contour 126 form a first and second chopstick.

Figure 4A:
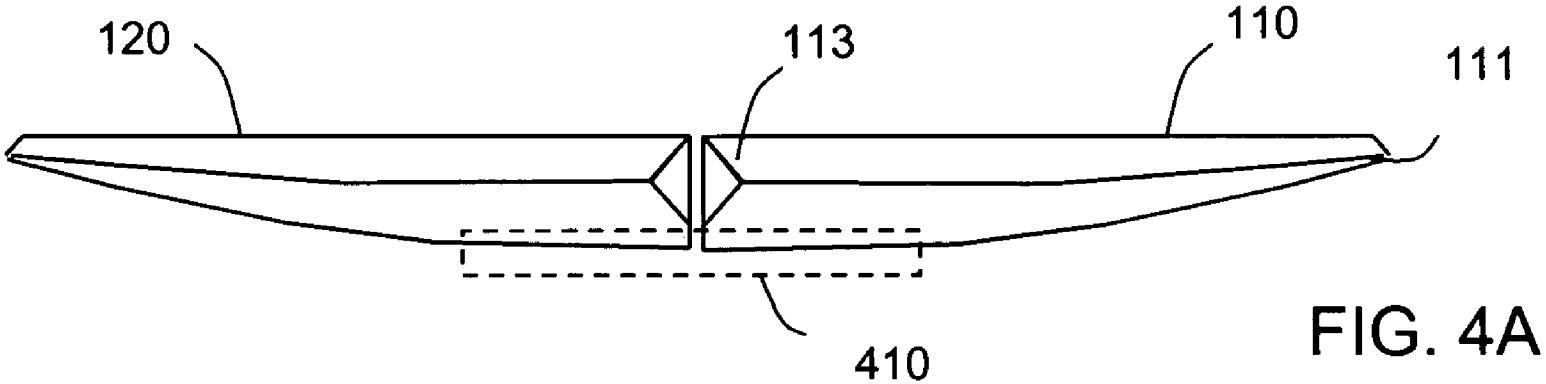
FIG. 4A is a frontal view of a spoon aspect of the multi-purpose eating utensil in accordance with an embodiment of the present invention.
Figure 4B:
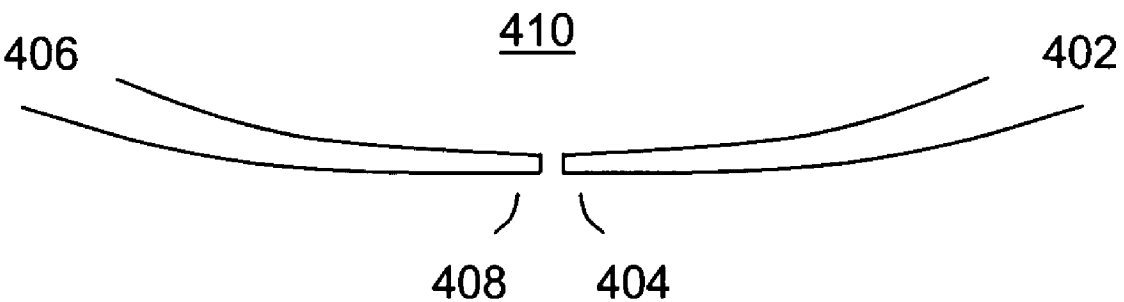
FIG. 4B is a frontal cross section view of a spoon bottom aspect of the multi-purpose eating utensil in accordance with an embodiment of the present invention.

Referring to FIG. 4A, a frontal view of the eating utensil 100 is shown. Notably, the frontal view shows the forward projecting tine tips 113, the outer edge 111, and the generally flat spoon bottom 410. Notably, the outer edge of the tine tip 113 can lead to a sharp outer cutting edge for providing the knife aspect. Accordingly, the tine tip 113 can be triangular in shape to provide a cutting edge while also providing a tine aspect. Referring to FIG. 4B, a frontal cross section of the eating utensil along a center region of the flat spoon bottom 410 is shown. Notably, the material width of the first spoon portion 110 decreases from a first width 402 to a second width 404. Similarly, the material width of the second spoon portion 120 decreases from a first width 406 to a second width 408. Notably, the material width tapers from an outside edge of a spoon portion downward to an interior edge of the spoon portion, respectively. The tapering effect can be symmetrical to both the first spoon portion 110 and second spoon portion 120. Understandably, the tapering allows the half spoons 110 and 120 to get under food objects and raise them into the spoon platform. For example, a user can scoop up a small food object such as rice into the spoon platform by squeezing the first member 104 and second member 106 thereby closing the eating utensil 100 and elevating the food into the platform region. The rice will be pushed upward along the tapering edge as the first interior edge 115 and second interior edge conjoin, or mate.

The frontal cross section view also reveals the slight curvature of the spoon aspect in addition to the tapering aspect when formed by the closing of the first spoon portion 110 and second spoon portion 120. The spoon aspect can be characterized as smooth and slightly curved with a relatively flat spoon bottom, or bowl. From a top view, the first spoon portion 110 and second spoon portion 120 when conjoined can be relatively wide. From the front view, the conjoined spoon portions exhibit a sufficiently shallow depth area. Together, the relatively wideness and the shallowness features allow the eating utensil 100 to scoop up, slide under, or support food when the eating utensil 100 is closed or partially open. The eating utensil 100 can be used as a spoon when in a closed configuration, or as a pair of tongs for scooping food into the shallow spoon platform when manipulated from an open to a closed configuration. The relatively shallow and flat aspect of the eating utensil 100 in the open or closed configuration facilitate the serving of small food objects such as h'orderves or pastries. The first and second spoon portions 110/120 can be used together in combination similar to tongs or chopsticks for grabbing or handling food.

Although the present specification describes features and functions implemented in the embodiments with reference to particular utensil arrangements, the disclosure is not limited to such use or practice. The illustrations of embodiments described herein are intended to provide a general understanding of the structure of various embodiments, and they are not intended to serve as a complete description of all the elements and features of apparatus and systems that might make use of the structures described herein. Many other embodiments will be apparent to those of skill in the art upon reviewing the above description. Other embodiments may be utilized and derived therefrom, such that structural and logical substitutions and changes may be made without departing from the scope of this disclosure. Figures are also merely representational and may not be drawn to scale. Certain proportions thereof may be exaggerated, while others may be minimized. Accordingly, the specification and drawings are to be regarded in an illustrative rather than a restrictive sense.

In light of the foregoing description, it should be recognized that embodiments in accordance with the present invention can be realized with different materials, manufacture, or methods of production. In light of the foregoing description, it should also be recognized that the eating utensil in accordance with the present invention can be realized in numerous configurations contemplated to be within the scope and spirit of the claims. Additionally, the description above is intended by way of example only and is not intended to limit the present invention in any way, except as set forth in the following claims.

What is claimed is:

1. An eating utensil comprising:

a handle having two members within a first segment separated by an opening and extending longitudinally from a base portion, said two members diverge along a second segment wherein said opening increases from a narrow space to a wider space, wherein a first member opens into a first spoon portion having a first interior edge, and a second member opens into a second spoon portion having a second interior edge, such that a closing of said two members mates said first interior edge and second interior edge for creating a spoon aspect and wherein said first spoon portion leads to a first tine and said second spoon portion leads to a second tine for providing a fork aspect when said two members are at least partially open and together provide a single prong aspect when said two members are closed; and wherein said first interior edge has a first winding contour followed by a straight contour, and said second interior edge has a second winding contour followed by a straight contour, said second winding contour is complementary to said first winding contour such that a closing of said two members conjoins said first interior edge and second interior edge for creating said spoon aspect.

2. The eating utensil of claim 1, wherein said first spoon portion and second spoon portion have a material width that progressively decreases and tapers downwards from an outer edge to an interior region towards a center spoon bowl region.

3. The eating utensil of claim 1 wherein said first and said second tines slightly project forward from said spoon portion, said tines having ridges for gripping, and a tip area approximating the tip of a fork tine.

4. The eating utensil of claim 1, wherein at least one spoon portion has a sharp edge along an outside portion for providing a knife aspect, wherein the edge is angled such that a turning of the eating utensil on a side in a normal handling configuration positions the edge horizontally.

5. The eating utensil of claim 1, wherein said utensil is angled at a position that corresponds to a general region where an index finger and a thumb are placed for closing said two members from an open configuration for providing a chopstick aspect, wherein said handle provides support for handling said eating utensil during compressive movement of said index finger and said thumb.

6. The eating utensil of claim 1, wherein each of the first and second spoon portions has slight upward curvature at a frontal and a rear portion, slight upward curvature along a first and second outer portion, and a generally flat aspect along an interior portion such that said spoon has a generally flat bottom for providing a platform.

7. The eating utensil of claim 1, wherein said eating utensil is made entirely of a single piece of metal that provides flexibility and spring for opening and closing said two members, wherein said two members are in a natural open configuration.

8. The eating utensil of claim 1, wherein said first spoon portion and second spoon portion have wide curvature sides for providing an enclosed platform to scoop objects into when said two members are closing.

9. The eating utensil of claim 1 wherein said first tine and said second tine extend from said first spoon portion and second spoon portion for grasping, holding, and maneuvering objects between said tines.

10. An eating utensil comprising:

a first member having an irregular shaped interior edge having a winding contour;

a second member having a mating irregular shaped interior edge having a winding contour; and wherein said first member is coupled with said second member at a connection point, wherein the first member and the second member serve as a fork in a first configuration and the first and second member have a single tine each and serve as a spoon in a second configuration when the first and second members mate and wherein the eating utensil is made from a single piece of material and wherein said first member leads to a first tine and said second member leads to a second tine for providing a fork aspect when said two members are at least partially open and together provide a single prong aspect when said two members are closed.

11. The eating utensil of claim 10, wherein the first and second member are connected at a base and separated by an opening such that the first and second member are squeezed together for forming a spoon.

12. The eating utensil of claim 10, wherein the first and second member serve as chopsticks.

13. The eating utensil of claim 10, wherein the first and second member have a sharp outer edge to serve as a knife.

14. An eating utensil comprising:

a handle having two members within a first segment separated by an opening and extending longitudinally from a base portion, said two members diverge along a second segment wherein said opening increases from a narrow space to a wider space, wherein a first member opens into a first spoon-like portion having a first interior edge, and a second member opens into a second spoon-like portion having a second interior edge, such that a closing of said two members mates said first interior edge and second interior edge for creating a spoon-like aspect; and wherein the eating utensil has only two tines, a first tine on the first member and a second tine on the second member and wherein the two members serve the function of chopsticks when squeezed together and the first tine and the second tine together provide a fork aspect when the two members are at least partially open and the first tine and the second tine together provide a single prong aspect when the two members are closed.

15. The eating utensil of claim 14, wherein said first and second interior edges have mating winding contours on a portion of each edge that is substantial enough in both length and depth that a partially grid-like surface is created when the utensil is in at least a partially open configuration, which can improve its ability to support food.

16. The eating utensil of claim 15, wherein said first spoon-like portion and second spoon-like portion have a material thickness that progressively decreases and tapers downwards from an outer edge to an interior region towards a center bottom region.

17. The eating utensil of claim 14, wherein the spoon-like portions have a generally flat aspect from both a front view and a side view.

18. The eating utensil of claim 14, wherein as viewed from a top view in a closed configuration, a substantial portion of the middle of the spoon-like portions, which portion is oval shaped when closed, has a completely flat bottom surface, such that a portion having the winding contours can lay flat on a plate.

19. The eating utensil of claim 14, wherein rims of the spoon-like portions have gently curving top surfaces.

* * * * *